United States Patent [19]

Martin et al.

[11] 4,248,037

[45] Feb. 3, 1981

[54] YARN POSITIONING MEANS FOR OPEN-END SPINNING MACHINE PIECING APPARATUS

[75] Inventors: Charles R. Martin, Seneca; Philip B. Tarbox, Pendleton, both of S.C.; Stephen W. Yates, Bolton, England

[73] Assignee: Platt Saco Lowell Limited, Helmshore, England

[21] Appl. No.: 80,978

[22] Filed: Oct. 2, 1979

[51] Int. Cl.[3] ..... D01H 15/02

[52] U.S. Cl. ..... 57/263

[58] Field of Search ..... 57/261-263, 57/58.89-58.95

[56] References Cited

U.S. PATENT DOCUMENTS

| | | | |
|---|---|---|---|
| 3,546,870 | 12/1970 | Schewe et al. | 57/262 |
| 3,680,300 | 8/1972 | Landwehrkamp | 57/263 |
| 3,815,347 | 6/1974 | Nemec et al. | 57/263 |
| 3,821,878 | 7/1974 | Parsons | 57/263 |
| 4,083,171 | 4/1978 | Konig et al. | 57/263 |
| 4,142,358 | 3/1979 | Honjo | 57/263 |
| 4,150,532 | 4/1979 | Ligones | 57/263 |

*Primary Examiner*—John Petrakes

*Attorney, Agent, or Firm*—Joseph H. Heard; Donald H. Feldman

[57] ABSTRACT

During servicing of a spinning machine station by the piecing apparatus, the yarn positioning means establishes a generally U-shaped yarn line and brings the lowermost bight section of such line into desired association with the yarn delivery rolls at the spinning machine station. Rotatable members form the bight section of the yarn line and then transport the same, while the members occupy rotative positions effective to prevent lateral movement of the bight section, to a location closely adjacent the delivery rolls. The members then are rotated to other positions wherein they permit and guide lateral movement of the bight section toward a free end of one of the delivery rolls. When a piecing-aid device is present at the spinning machine station, the piecing apparatus includes a mechanism for imparting movement to a movable component of the device, and the positioning means of the apparatus includes means for associating parts of the U-shaped yarn line with the foregoing and other components of the device.

9 Claims, 22 Drawing Figures

YARN POSITIONING MEANS FOR OPEN-END SPINNING MACHINE PIECING APPARATUS

This invention relates to mobile apparatuses for piecing-up yarn at the various spinning stations of open-end spinning machines, and more particularly relates to the yarn positioning means carried by such an apparatus for during each piecing operation establishing a yarn line extending in a desired manner relative to and in association with the delivery rolls of the spinning machine station undergoing servicing.

During normal operation on open-end spinning machines, the yarn produced at each of its spinning stations passes from the spinning unit thereat, thence through the nip of a pair of delivery rolls, and thence to a take-up assembly where the yarn is wound to form a package. Upon breakage of the yarn at a station of the spinning machine, the foregoing yarn line must be re-established and various types of mobile piecing apparatuses have heretofore been proposed for performing the aforesaid function. However, the spinning machines serviced by the prior-art piecing apparatuses are of the type wherein at each station the delivery rolls lie at an elevation intermediate that of the spinning unit and that of the yarn take-up assembly, such that the yarn line between the latter components is a generally straight and vertical one that extends to, through and from the delivery rolls without any marked reversals of direction. During a piecing operation such a yarn line can be formed relatively easily, and its introduction into the nip of the delivery rolls, which normally consist of an elongate drive roll and a stub-type pressure roll, can be and usually is effected simply by releasing a laterally and forwardly deflected expanse thereof and allowing the same to undergo free return movement, frequently over a substantial distance and in an unsupported manner, rearwardly to the elongate drive roll and along its length to the nip "entrance" at the free end of the stub roll.

None of the prior-art piecing apparatuses are adapted or suitable for the servicing of another known type of open-end spinning machine whose spinning units are disposed at an elevation above that of the delivery rolls and below that of the yarn take-up assemblies so the yarn path of travel at each machine station is generally U-shaped, extending first downwardly from the spinning unit to and through the nip of the delivery rolls, thence forwardly about the undersurface of the stub-type delivery roll, and thence upwardly to the yarn package. A piecing apparatus suitable for the servicing of a spinning machine of this type, as opposed to a machine of the first-mentioned type, must be capable of efficiently and reliably forming a yarn-line of the more complex U-shaped configuration. It must also be capable of maintaining a high degree of control over such yarn line, and particularly the lowermost or bight section thereof, as the same is transported into association with the delivery rolls of the spinning machine station undergoing servicing. Uncontrolled free movement of the yarn line toward the delivery rolls, from a location spaced a substantial distance therefrom and as occurs in the servicings of spinning machines having substantially straight paths of yarn travel, is not permissable.

Although no automatic piecing apparatus possessing the foregoing capabilities has heretofore been devised or proposed, it is known to provide so-called piecing-aid devices in association with each of the spinning stations of a spinning machine of the type having a generally U-shaped yarn line. Such devices are usable by machine attendants to properly coordinate final steps of the piecing operations that otherwise are performed purely manually by the attendants. The devices perform the aforesaid function in a highly reliable manner, and an automatic piecing apparatus that is to service a spinning machine equipped with them preferably should additionally possess the capability to utilize such devices for similarly coordinating the final steps of its automatically performed piecing operations.

OBJECTS OF THE INVENTION

The primary object of the invention is the provision, in an automatic piecing apparatus adapted to service an open-end spinning machine of the type wherein the spinning unit at each station lies at an elevation above that of the delivery rolls and below that of the take-up assembly, of yarn positioning means for during each servicing operation efficiently redirecting yarn retrieved from the take-up package into a generally U-shaped line having a lowermost bight section disposed closely adjacent the delivery rolls and having rearward and forward sections respectively extending from opposite ends of such bight section to the elevation of the spinning unit and to the take-up package.

Another object is the provision of yarn positioning means, of the above-noted type, that is capable of cooperative use with piecing-aid devices provided upon the spinning machine for the purpose of properly coordinating certain of the final steps of yarn piecing operations performed at its spinning stations.

Still another object is the provision of yarn positioning means, of the type in question, that maintains a high degree of control over the yarn line during its formation and during the transfer of the bight section of such yarn line toward and into association with the delivery rolls of the spinning machine.

A related and more specific object is the provision upon the piecing apparatus of yarn transfer means effective to to form the bight section of the desired U-shaped yarn line at a location distal from the delivery rolls of the spinning station undergoing servicing to, then transport the yarn-like bight to a position closely adjacent the delivery rolls of the spinning station undergoing servicing, and to thereafter guide and direct the bight laterally toward the undersurface of the stub-type one of the delivery rolls.

SUMMARY OF THE INVENTION

The yarn positioning means of the invention includes two transfer means that in cooperation with each other redirect a substantially straight line of yarn, extended forwardly from the yarn package at the spinning station undergoing servicing by any suitable yarn-retrieving upon the piecing apparatus, into a generally U-shaped line have sections extending as described previously herein. One of the transfer means includes a pair of yarn engaging members that are mounted upon a support member for transalatory movement with the support member and also for movement relative to it between yarn retaining and yarn discharging positions. The bight section of the U-shaped yarn is formed by and extends between the yarn engaging members, while the members occupy their yarn retaining positions and are disposed at a location distal from the delivery rolls of the spinning machine. Movement of their support members then transports the yarn engaging members and the yarn bight thereon to a location below the elevation of the delivery rolls and wherein the members and the yarn bight thereon are disposed in closely adjacent relationship to the stub-type one of the delivery rolls. Upon then-ensuing movement of the members to their yarn releasing positions, the yarn bight is directed and guided toward free ends of the members and toward the vertical plane containing the free end of the stub-type delivery roll. In one embodiment of the invention the bight is passed immediately from the free ends of the members to the closely adjacent undersurface of the stub-type roll.

In another embodiment of the invention, which is the preferred embodiment when the open-end spinning machine has at each of its spinning stations a piecing-assist device of a type previously mentioned herein, the yarn-line bight is retained adjacent the free ends of the members pending return movement of an extendable and retractable loop-forming arm of the device to its retracted position. In this embodiment of the invention the yarn engaging members may be of slightly modified construction, and their support member carries additional components. These include means for associating the rearward section of the yarn line with a yarn retaining part of the piecing-assist device, and means for firstly effecting formation of a reserve loop in the rearward yarn line and for secondly effecting transfer of a part of such reserve loop to the movable loop-forming arm of the piecing-aid device. Additionally, in the second embodiment of the invention means are provided upon the piecing apparatus for moving the aforesaid loop-forming arm of the piecing-aid device between its extended and retracted positions.

In both embodiments of the invention movement of the yarn-engaging members relative to their support member preferably is effected by drive means carried by the support member and operable in response to arrival of the yarn engaging members at the terminal location thereof closely adjacent the stub-type delivery roll.

DESCRIPTION OF THE DRAWINGS

Other features of the invention will be apparent from the following description of preferred embodiments thereof, which should be read in conjunction with the accompanying drawings, in which.

DESCRIPTION OF THE PREFERRED EMBODIMENTS

Figure 1:
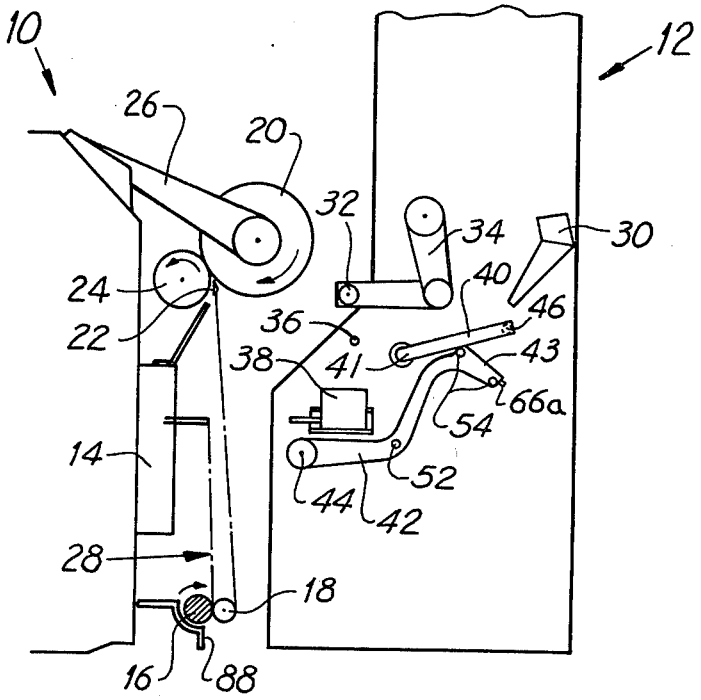
FIG. 1 is a partially schematic and fragmentary side elevational view of an open-end spinning machine and an automatic piecing apparatus, having yarn positioning means in accordance with the invention, for servicing the machine.

In FIG. 1 of the drawings, the numerals 10 and 12 respectively designate an elongate open-end spinning machine and a yarn-piecing apparatus for servicing such machine. A plurality of identical spinning stations, of which one is schematically shown in FIG. 1, are spaced along the length of machine 10. The spinning station includes a spinning unit 14, a delivery roll assembly disposed at an elevation below the spinning unit, and a yarn take-up assembly disposed at an elevation above the spinning unit. The delivery roll assembly includes an elongate drive roll 16 and a stub-type pressure roll 18 that extend in parallel relationship to each other in the length direction of machine 10 and that define a yarn-receiving nip therebetween. The yarn take-up assembly includes a yarn take-up package 20, a traversing yarn guide 22, a package drive roll 24, and package support means 26 that mounts package 20 for pivotal movement relative to the axis of package drive roll 24. Yarn spun at the spinning station during its normal operation extends along the generally U-shaped path of travel 28 designated by broken lines in FIG. 1, passing first downwardly from the outlet tube of spinning unit 14 to and through the nip of delivery rolls 16, 18; thence about stub-type pressure roll 18; and thence upwardly through traversing guide 22 to package 20, upon which the yarn is wound due to the package's then-ensuing engagement with and rotation (in a clockwise direction, as viewed in FIG. 1) by the rotating package drive roll 24. Upon breakage or other interruption of the yarn path of travel at the spinning station, stop-motion means (not shown) upon machine 10 halts the supply of silver (not shown) to spinning unit 14, and the free end of the broken yarn is wound upon take-up package 20. Rotation of package 20, and of drive roll 24 and delivery rolls 16, 18, continues notwithstanding the then non-productive state of the spinning station.

Piecing apparatus 12 is adapted to move along the length of machine 10 to its illustrated position forwardly of the non-productive spinning station, and to then re-establish the generally U-shaped yarn path of travel 28 at such station. The means by which apparatus 12 is movable to and halted at its FIG. 1 position, as well as other components that similarly are irrelevant to an understanding of the present invention, are not shown in the drawings. Among the illustrated components of apparatus 12 are yarn retrieving means in the form of a suction nozzle 30, and a yarn-package lifting and rotating wheel 32 supported by a linkage 34; a movable yarn guide member 36; a piecing-head mechanism 38; and elongate support arms 40, 42 forming a part of yarn positioning and transfer means of apparatus 12.

Figure 8:
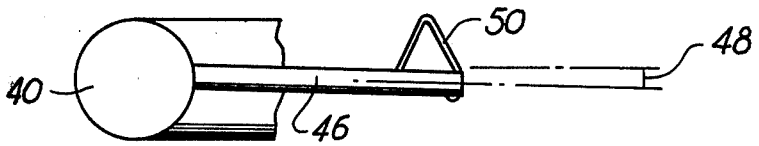
FIGS. 8 and 9 respectively are enlarged fragmentary rear elevational and perspective views of the free end portion of a support arm, constituting a part of the yarn positioning means of the piecing apparatus of FIGS. 1–7.
Figure 9:
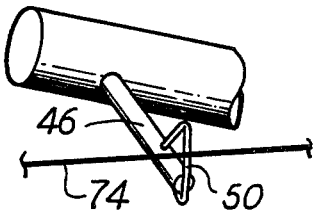

Arm 40 is mounted at one end upon apparatus 12 for pivotal movement about an axis 41 extending parallel to delivery rolls 16, 18 of spinning machine 10. As is best shown in FIGS. 8 & 9, a generally cylindrical yarn engaging member 46 projects laterally from one side of the free end portion of arm 40. Member 46 extends at a slight angle relative to the horizontal, such angle being designated by the numeral 48 in FIG. 8, and has upon one side of its free outer end portion a sloping yarn-deflecting element 50.

Support arm 42 is mounted upon apparatus 12 for pivotal movement about an axis 44 (FIG. 1) that is parallel to but spaced radially from the pivot axis 41 of arm 40. The vertical plane of the path of pivotal movement of support arm 42 is spaced closely from the vertical plane of the path of pivotal movement of support arm 40, and is located on that side of support arm 40 from which yarn engaging member 46 projects.

A yarn guide pin 52 (FIGS. 1–7, and corresponding to the pin 52' shown in FIG. 17) projects laterally from a medial portion of the leading edge of arm 42, and a pair of generally cylindrical yarn-engaging members 54 (FIGS. 1–7 & 10–13) project laterally outwardly from the enlarged and generally block-like free outer end portion or head 43 of such arm. The foregoing components are all disposed upon that side of arm 42 adjacent the vertical plane of the arcuate path of travel of arm 40. Their length is such that they terminate short of the vertical plane containing the path of pivotal movement of support arm 40, but project through the vertical plane of the path of pivotal movement of the free end of the yarn engaging member 46 upon arm 40. Members 54 are parallel to the pivot axis 44 of arm 42.

Referring now particularly to FIGS. 10–13, adjacent its inner end portion each member 54 has yarn-retaining means in the form of a generally V-shaped notch 56. Upon the side thereof opposite its notch 56, each member 54 has yarn-releasing and/or guiding means in the form of an inclined surface 58 that slopes from the circumference of the inner end portion of the members 54 to its free outer end and its central axis.

Figure 10:
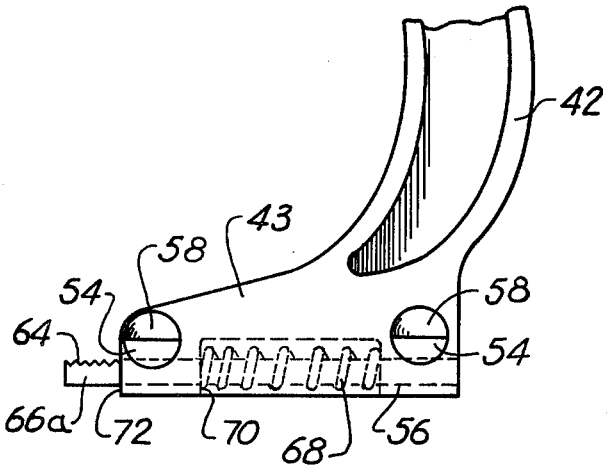
FIGS. 10 and 11 are respectively enlarged fragmentary side elevational and exploded-perspective views of the free end portion of another support arm of the piecing apparatus yarn positioning means.
Figure 11:
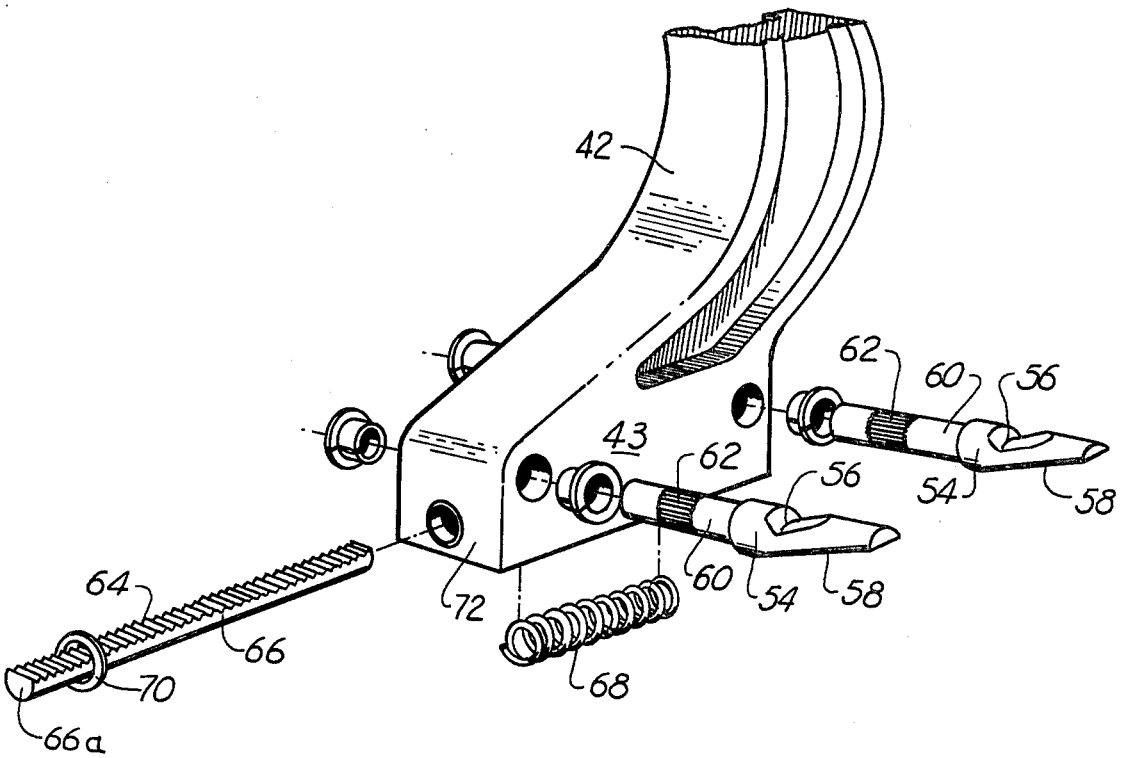
Figure 12:
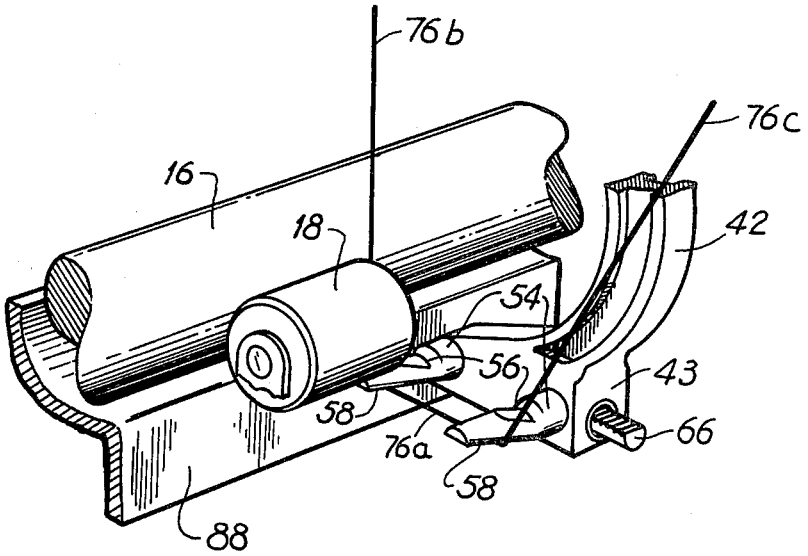
FIGS. 12 and 13 respectively are fragmentary perspective and front elevational views of the free end portion of the piecing apparatus support arm of FIGS. 10 and 11, in association with the delivery roll assembly of the spinning machine station shown in FIGS. 1–7.
Figure 13:
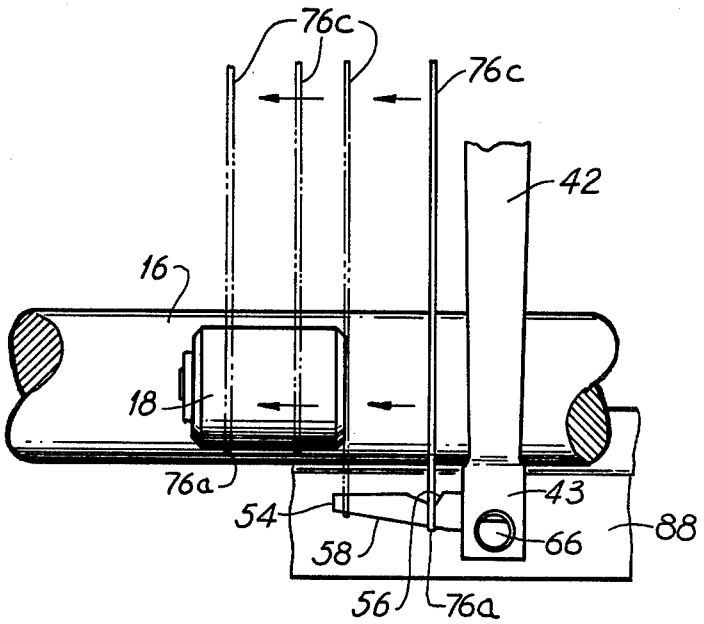

Mounting and drive means, best shown in FIGS. 10 & 11, so innerconnect members 54 with head 43 of support member 42 as to at desired times permit and cause members 54 to undergo 180 degree rotative movement, in unison with each other and about their respective central axes, between yarn retaining (FIG. 10) and yarn releasing (FIG. 11) rotative positions. In the yarn retaining positions of members 54 their notches 56 face generally outwardly or away from the axis 44 about which arm 42 pivots. In the yarn releasing rotative positions of members 54 their inclined surfaces 58 thereon face in the aforesaid direction, and their notches 56 face in the opposite direction. Each member 54 is supported for the aforesaid axial rotative movement by a shaft 60 rotatably mounted within head 43 of support arm 42 by suitable bearings. A gear 62 is secured upon, or (as shown) formed integrally with, the circumferential surface of each shaft 60. Gears 62 are drivably engaged by rack-like gear teeth 64 extending along the length of an elongate plunger member 66 mounted within head 43 of arm 42 for axial reciprocatory movement between extended and retracted positions. Biasing means, in the form of a compression spring 68 encircling a medial portion of plunger 66 and engaging a collar 70 secured thereto, biases plunger 66 to its extended position shown in FIGS. 1–6 & 10, and wherein one end portion **66*a* thereof projects through and beyond an end face 72 of head 43 of arm 42. When plunger 66 occupies its aforesaid extended position, to which it is biased by spring 70, members 54 occupy their previously discussed yarn retaining rotative positions (FIG. 10). In the retracted position of plunger 66, the end of its portion 66*a* is disposed closely adjacent face 72 of head 43 of arm 42. In response to movement of plunger 66 from its extended and to its retracted position, gears 62, 64 cause members 54 to undergo 180 degree rotative movement from their yarn retaining positions (FIG. 10) to their yarn releasing positions (FIGS. 11–13**).

All components of piecing apparatus 12 are shown in FIG. 1 in the "parked" positions that they occupy when not in use. At the outset of the performance of a piecing operation by apparatus 12, wheel 32 is moved by its supporting linkage 34 from its FIG. 1 position to an extended position, shown in FIG. 2, wherein it engages the undersurface of yarn take-up package 20 and lifts the same out of engagement with package drive roll 24. Wheel 30 is then rotatively driven in a direction (clockwise as viewed in FIG. 2) causing the yarn package 20 supported thereby to rotate in a reverse or unwinding direction opposite that of its normal rotation. Suction nozzle 30 then moves from its parked FIG. 1 position to an extended position (not shown in the drawings) wherein the nozzle is disposed sufficiently close to the periphery of the lifted and reversedly-rotating yarn package 20 as to suck into its interior the broken end and succeeding lengths of yarn wound upon the package. Return movement of suction nozzle 30 back to its parked position establishes a line 74 (FIG. 2) of running yarn extending generally forwardly from package 20 and into suction nozzle 30. Further description of the aforesaid yarn-retrieving components of apparatus 12 is deemed unnecessary since comparable components have heretofore been utilized in mobile piecing apparatuses and are well known to those skilled in the art.

Figure 2:
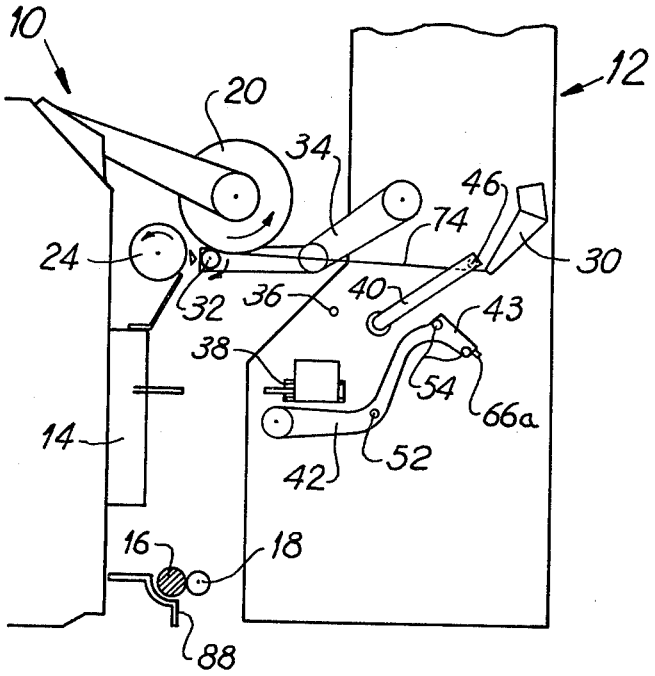
FIGS. 2–7 are sequential views, showing components of the FIG. 1 machine and apparatus in the positions occupied thereby at different times during the performance of a servicing operation by the apparatus.

Following establishment of yarn line 74 by the yarn-retrieving means, arm 40 pivots in a counterclockwise direction from its parked position shown in FIG. 1 and wherein its yarn-engaging member 46 underlies such yarn line, to its position shown in FIG. 2 and wherein member 46 overlies yarn line 74. During such movement of arm 40, yarn line 74 is engaged and deflected laterally (see FIG. 9) past the free end of member 46 by the latter's yarn deflecting element 50. This permits movement of member 46 above the yarn line, which then returns to substantially its original position.

Figure 6:
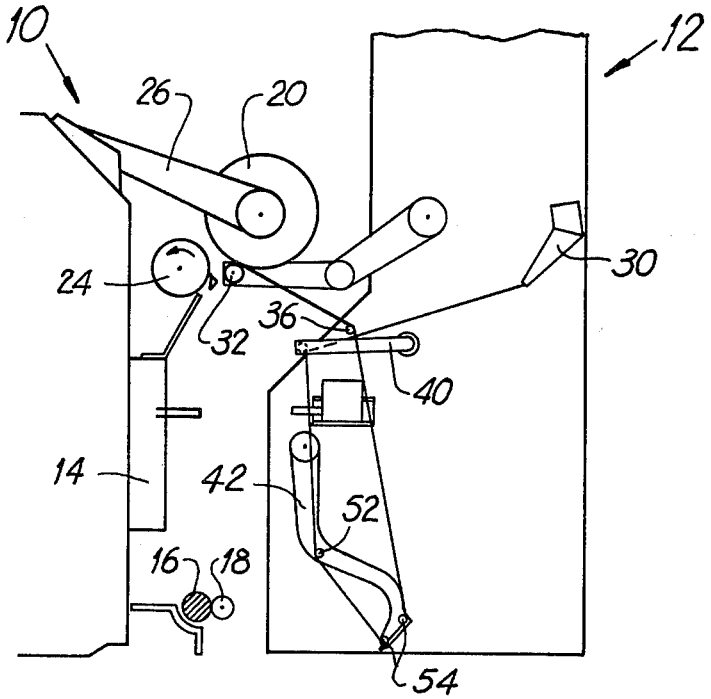
Figure 7:
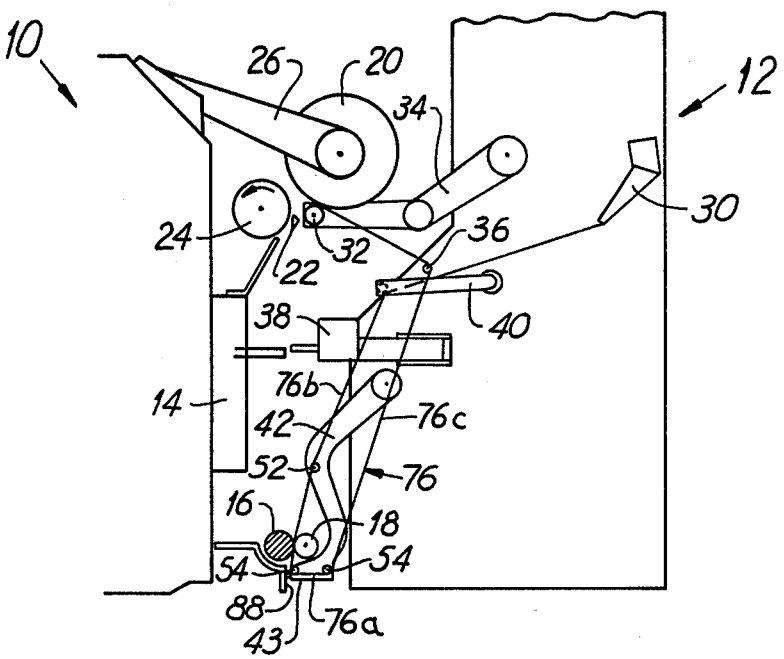

Arm 40 nextly undergoes a stroke of pivotal movement in a clockwise direction from its position shown in FIG. 2 to its position shown in FIG. 7. After arm 40 has completed all or substantially all of its aforesaid stroke of pivotal movement, arm 42 undergoes a stroke of clockwise pivotal movement from its initial parked position, shown in FIG. 1 and wherein its head 43 is disposed distal from delivery rolls 16, 18 of machine 10, to a terminal position near that shown in FIG. 7 and wherein its head 43 is located beneath the elevation of delivery roll 18 and adjacent the vertical plane of the roll's free end. During the aforesaid strokes of pivotal movement, the member 46 upon the outer end portion of arm 40 and the members 54 upon head 43 of arm 42 engage the yarn running from package 20 to suction nozzle 30 and, in cooperation with each other, reshape its line into a generally U-shaped configuration. The aforesaid yarn line is designated by the numeral 76 in FIG. 7 and includes a bight section **76*a* disposed closely adjacent the free end of stub-type delivery roll 18 for entrainment thereon, a rearward section 76*b* extending from bight section 76*a* to an elevation above spinning unit 14, and a forward section 76*c* extending upwardly from bight section 76*a* to yarn package 20. The manner in which the yarn line is modified in shape from its FIG. 2 to its FIG. 7 configuration can best be understood by reference to FIGS. 3–6, which show the intermediate shapes which the yarn line is caused to assume during pivotal movement of arms 40, 42 from their positions of FIG. 2 and to their positions of FIG. 7**.

Figure 3:
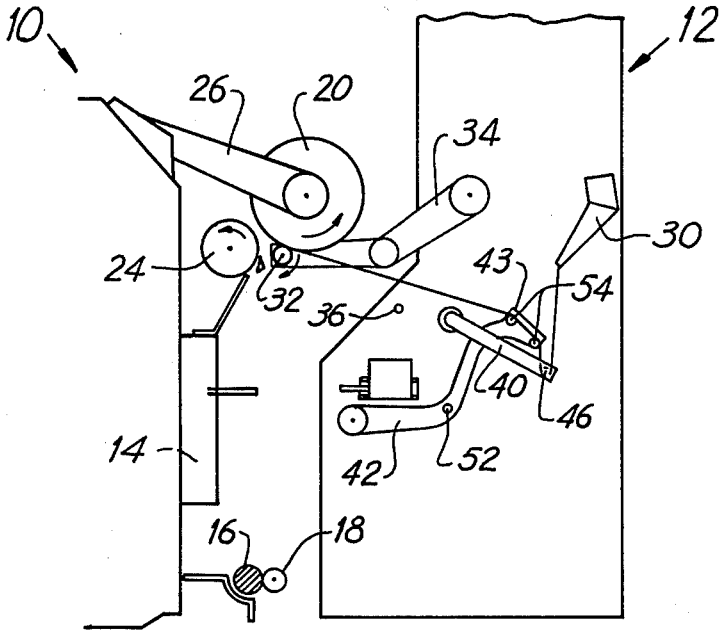

As arm 40 pivots from its FIG. 2 and to its FIG. 3 position, member 46 entrains the yarn line, and deflects the same downwardly. The previously-mentioned slight inclination of member 46 also causes the thereby engaged section of the yarn line to commence lateral movement toward, and eventually to, the inner end of member 46. As member 46 passes through the elevation of head 73 of arm 42, which still occupies its parked position, a part of the yarn line expanse between member 46 and package 20 is received by and within the yarn-retaining notches 56 of the members 54 upon head 73. The part of the yarn line within and between notches 56 constitutes the bight section **76*a* of the generally U-shaped yarn line 76 of FIG. 7**.

Figure 4:
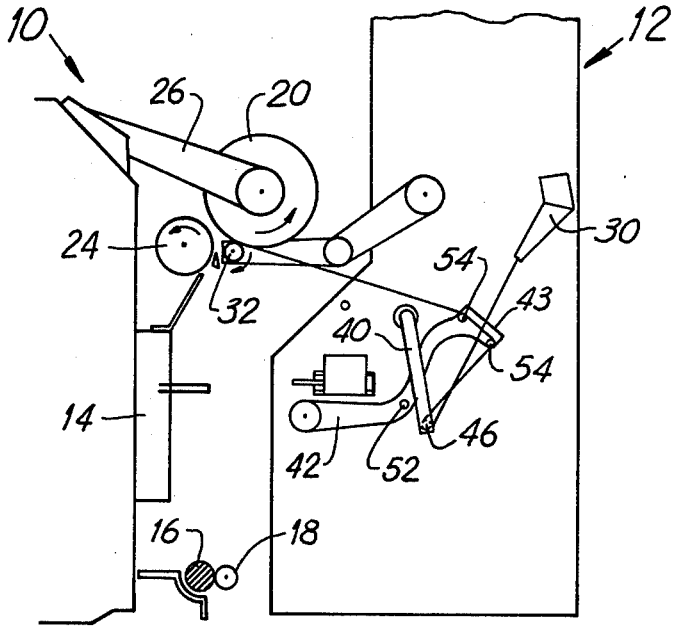

Referring to FIG. 4, arm 42 remains stationary in its parked position while arm 40 continues its pivotal movement to a position wherein the lower end of the yarn line expanse between its member 46 and suction nozzle 30 is moving rearwardly (i.e., towards spinning machine 10) past the outer ends of members 54. Its aforesaid lower end has moved sufficiently toward the inner end of member 46 as to prevent such yarn-line expanse from engaging members 54.

Figure 5:
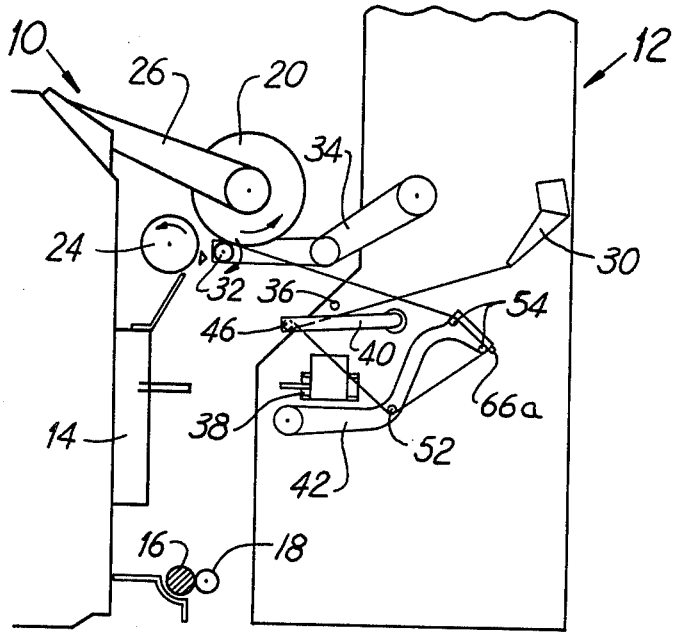

In FIG. 5 arm 40 has completed its clockwise stroke of pivotal movement and its member 46 is disposed at an elevation above that of piecing-head mechanism 38 and the outlet tube of spinning unit 14. The part of the yarn line upon member 46 now extends almost completely about member 46 and has been moved laterally to the inner end of such member. During movement of arm 40 from its FIG. 4 position to its FIG. 5 position, the expanse of the yarn line between its member 46 and head 43 of arm 42 is engaged and retained adjacent the leading edge of arm 42 by the guide 52 thereon. Clockwise pivotal movement of arm 42 toward delivery rolls 16, 18 of machine 10, and therefore the transporting toward such rolls of the yarn line bight extending between such arm's members 54, is about to commence. During the initial part of such pivotal movement of arm 42, that expanse of the yarn line between members 54 and yarn package 20 is brought into lateral engagement (see FIG. 6) with movable yarn guide 36 of apparatus 12.

FIG. 6 shows arm 42 adjacent the lowermost part of its clockwise path of pivotal movement. Up to this time in the operation of apparatus 12, package supporting wheel 32 has continued to impart rotation in an unwinding direction to yarn package 20, thereby insuring that most if not all of the yarn utilized in yarn line formation is "fresh" and free from possible tangles, as might not always be the case if apparatus 12 instead utilized only yarn withdrawn from suction nozzle 30. However, at approximately the time that arm 42 reaches its FIG. 6 position, wherein its members 54 are approaching that point in their path of travel most distal from package 20, rotation of wheel 32 and therefore of package 20 are halted. This reduces the possibility of the yarn line developing an undesirable degree of slackness during final pivotal movement of arm 42 its FIG. 7 position.

FIG. 7 shows arm 42 in the position that it occupies immediately prior to completing the final small increment of its counterclockwise movement. The desired yarn line 76 of generally U-shaped configuration has been completed established. Piecing-head mechanism 38 of apparatus 12 has moved from its previously-occupied parked position to a position wherein it has become operatively associated with the upper part of yarn line section **76*b*, and wherein the mechanism is disposed closely adjacent the yarn outlet tube of spinning unit 14. Mechanism 38 has components effective upon actuation thereof to cut the yarn in association therewith, and to bring the cut end of such yarn into such proximity with the discharge tube of spinning unit 14 as to cause the yarn end to be drawn into the spinning unit by the suction forces therewithin. Further description of mechanism 38** is deemed unnecessary since its particular construction does not form part of the present invention, and mechanisms for performing the foregoing functions are known to those skilled in the art.

Referring now to FIGS. 12 & 13, as well as to FIG. 7, the final pivotal movement of arm 42 brings its members 54 into positions where the outer portion of the leading (rearward, as viewed in FIGS. 7, 12 & 13) one of them underlies the nip of rolls 16, 18; and the outer portion of the other (forward) member 54 lies closely below the tangential plane of the bottom, and closely forwardly of the tangential plane of the front, of the stub-type delivery roll 18. The vertical plane containing the face of the free right (as viewed in FIGS. 12 & 13) end of delivery roll 18 projects through members 54 intermediate their lengths, such that the outer ends of such members lie upon the left side of such plane and the yarn-line bight section **76*a* upon its inner portions is disposed upon the other (right) side thereof. If section 76*a* of yarn line 76 were moved toward and from the outer ends of members 54, it and the lower parts of yarn line section 76*b* and 76*c* would therefor pass into entrained engagement with the respective bottom, rear and front surfaces of stub-type delivery roll 18. This ensues as final clockwise pivotal movement of arm 42 brings the end of projecting portion 66*a* of plunger 66 into engagement with abutment means 88 provided upon or (as shown) constituting part of the frame of machine 10, and effects (in relation to head 43 of arm 42) retraction of plunger 66. Retraction of plunger 66 rotates members 54 180 degrees, as a result of which the ends of yarn-line bight section 76*a* previously engaged and retained within notches 56 of members 54 engage surfaces 58 of such members. Due to the inclination of surfaces 58 and the tensioned condition of yarn line 76, its section 76*a* moves laterally, as indicated in FIGS. 12 and 13, to and from the free ends of members 54 and upwardly to the undersurface of delivery roll 18. The lower parts of yarn line sections 76*b* and 76*c* pass at substantially the same instant into engagement with the respective rear and front surfaces of roll 18, completing the entrainment procedure and effecting further lateral movement of the entrained yarn axially of delivery roll 18 to its normal "running" position (the left-most phantom-line one of FIG. 13**) thereon.

Entrainment in the aforesaid manner of yarn-line bight section 76*a* upon delivery roll 18 must of course be well coordinated with the operation of other components of apparatus 12, such as its mechanism (not shown) for actuating the silver feed switch and thus restarting silver feed to spinning unit 14, and the components of piecing head mechanism 38 that are determinative of the time when spinning unit 14 effects yarn-sliver "piecing" and again commences yarn production. Preferably entrainment occurs immediately prior to or substantially simultaneously with the resumption of yarn production by unit 14. Also, substantially simultaneously with or immediately after such entrainment, package supporting wheel 32 must be and is retracted so as to cause package 20 to again be rotated in a winding direction by its drive roll 24. As engagement between package 20 and its drive roll 24 is re-established, guide 36 (FIGS. 1–7) of apparatus 12 is moved so as to effect release of the yarn line previously engaged by it. Such line straightens and is automatically received, in a known manner, by traversing guide 22 of machine 10. Piecing head mechanism 38 and arms 40, 42 are then returned to their FIG. 1 parked positions of readiness for another cycle of operation.

Figure 14:
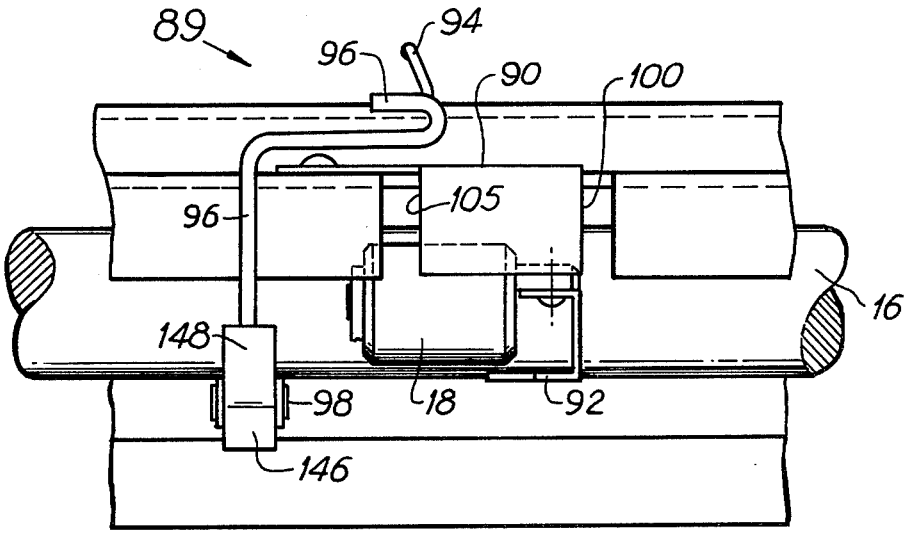
FIGS. 14–16 respectively are front elevational, side elevational and top plan views of a piecing-aid device associated with a spinning machine delivery roll assembly of the type shown in FIGS. 12 and 13.
Figure 15:
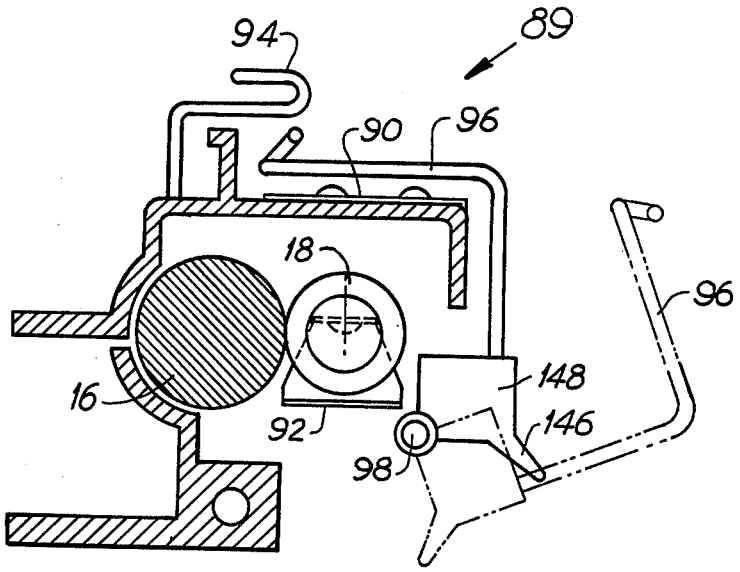
Figure 16:
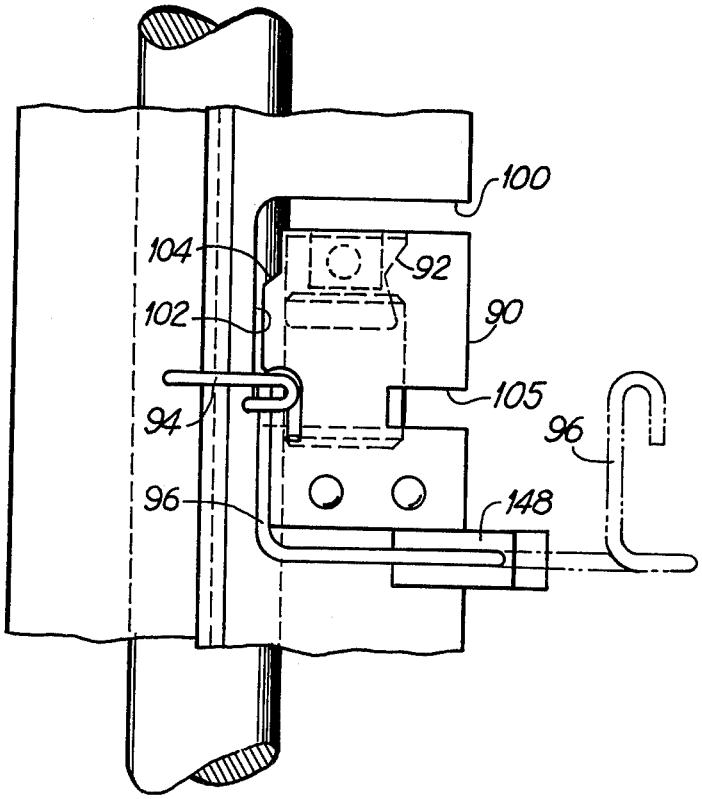

Proper coordination and timing of the steps of a piecing operation, particularly the step of establishing yarn production at the spinning unit and the step of associating the yarn with the delivery rolls, is required irrespective of whether the piecing operation is performed automatically by a piecing apparatus or manually by a spinning-machine attendant. In recognition of such fact, it has heretofore been proposed to provide devices, in association with respective ones of the stations of open-end spinning machines, for aiding an attendant in properly performing and coordinating the aforesaid steps of an otherwise manually-performed piecing operation. One such piecing-aid device 89, that is of a type that has been proposed for use in association with a spinning machine such as the previously-described machine 10, is shown in FIGS. 14–16 of the drawings. Device 89 includes a slotted plate 90 fixedly overlying delivery rolls 16, 18; a notched plate 92 fixedly underlying the free end portion of the stub-type delivery roll 18; and cooperating loop-forming members 94, 96, of which the latter is pivotably movable about an axis 98 between the retracted and extended positions thereof respectively shown by solid and phantom lines in FIGS. 15 & 16. During use of device 89 an attendant withdraws a length of yarn from the yarn take-up package at the spinning station with which the device is associated, such package having been previously raised by the attendant out of engagement with the package drive roll, and passes the same first downwardly to the elevation of notched plate 92; thence rearwardly across the undersurface of such plate; thence upwardly through slot 100 and/or 102 of plate 90; thence along the forward edge of slot 100 and into engagement with a yarn restraining shoulder 104 upon such edge; thence angularly forwardly through the hook-like end of the then-extended member 96; thence rearwardly through the hook-like end portion of member 94; and finally upwardly to the outlet tube of the spinning unit at the spinning station undergoing servicing. After establishing the foregoing yarn path and adjusting the length of the upwardly extending yarn, the attendant inserts the end of the upwardly extending yarn into the discharge tube of the spinning unit, wherein it is retained by therepresent suction forces. He then actuates the silver-feed switch (not shown) and pivots member 96 from its extended (phantom line) to its retracted (solid line) position. The movement of member 96 to its retracted position eliminates the yarn loop previously extended between it and member 94, causing suction-motivated feed-back of the yarn end into the spinning unit, silver-yarn piecing and the resumption of yarn production by the spinning unit. Coordinated introduction of the yarn into the delivery rolls arises from the fact that, when member 96 reaches its fully-retracted position, its hook-like end portion is vertically aligned with slot 100. The resultant forces then acting upon the yarn extending from member 96 into and through slot 102 therefore are such as to pull the yarn past shoulder 104 toward the closed end of slot 102, and into the nip of rolls 16, 18. The bight of yarn underlying plate 92 moves from such plate to the undersurface of delivery roll 18, and the forward section of the yarn moves along the front of plate 90 to and into a third slot 105 provided within plate 90 at the "running" position of the entrained yarn line.

Figure 20:
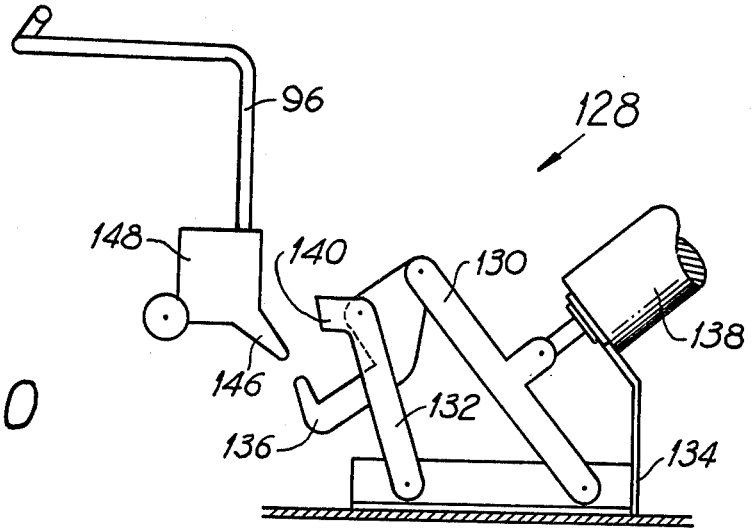
FIG. 20 is a side elevational view of the pivotably movable loop-forming arm of the piecing-aid device of FIGS. 14–17, and of a piecing apparatus mechanism for imparting pivotal movement to such arm.
Figure 21:
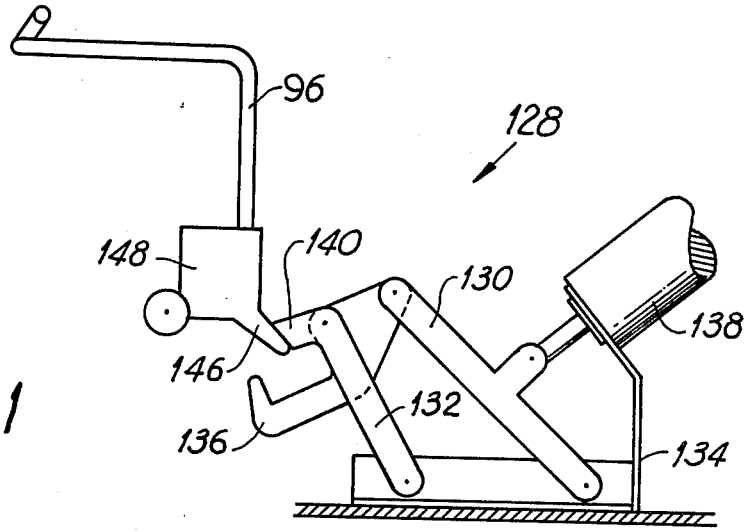
FIGS. 21 and 22 are sequential views showing the FIG. 20 arm and mechanism in the positions occupied thereby at different times during operation of the mechanism.
Figure 22:
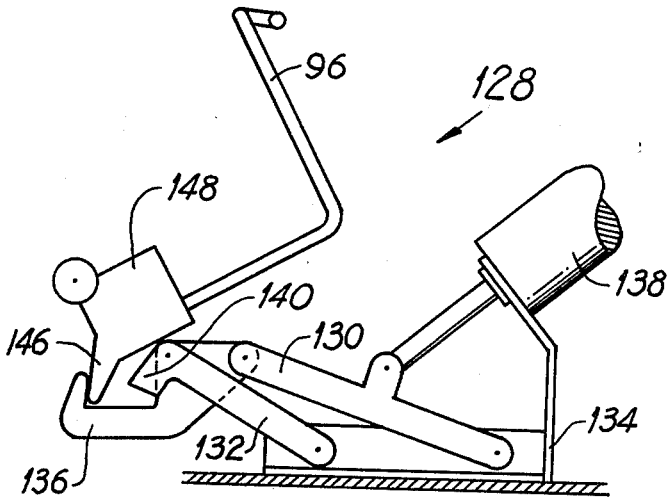

When a spinning machine to be serviced by a mobile piecing apparatus also possesses devices 89 of the above-described type, the apparatus desirably should be capable of utilizing such devices since they are of marked assistance in, among other things, properly coordinating the operational steps of "piecing" and delivery-roll entrainment of the yarn. Such capability may be accorded the previously-described piecing apparatus 12 by the provision thereon of a suitable mechanism 128, as shown in FIGS. 20–22 and to be subsequently described, for moving member 96 (FIGS. 14–17) of each device 89 between its extended and retracted positions; and by the utilization upon the apparatus of a support arm 42' shown in FIG. 17 and differing from the previously-described arm 42 only with respect to the components mounted thereon.

Figure 17:
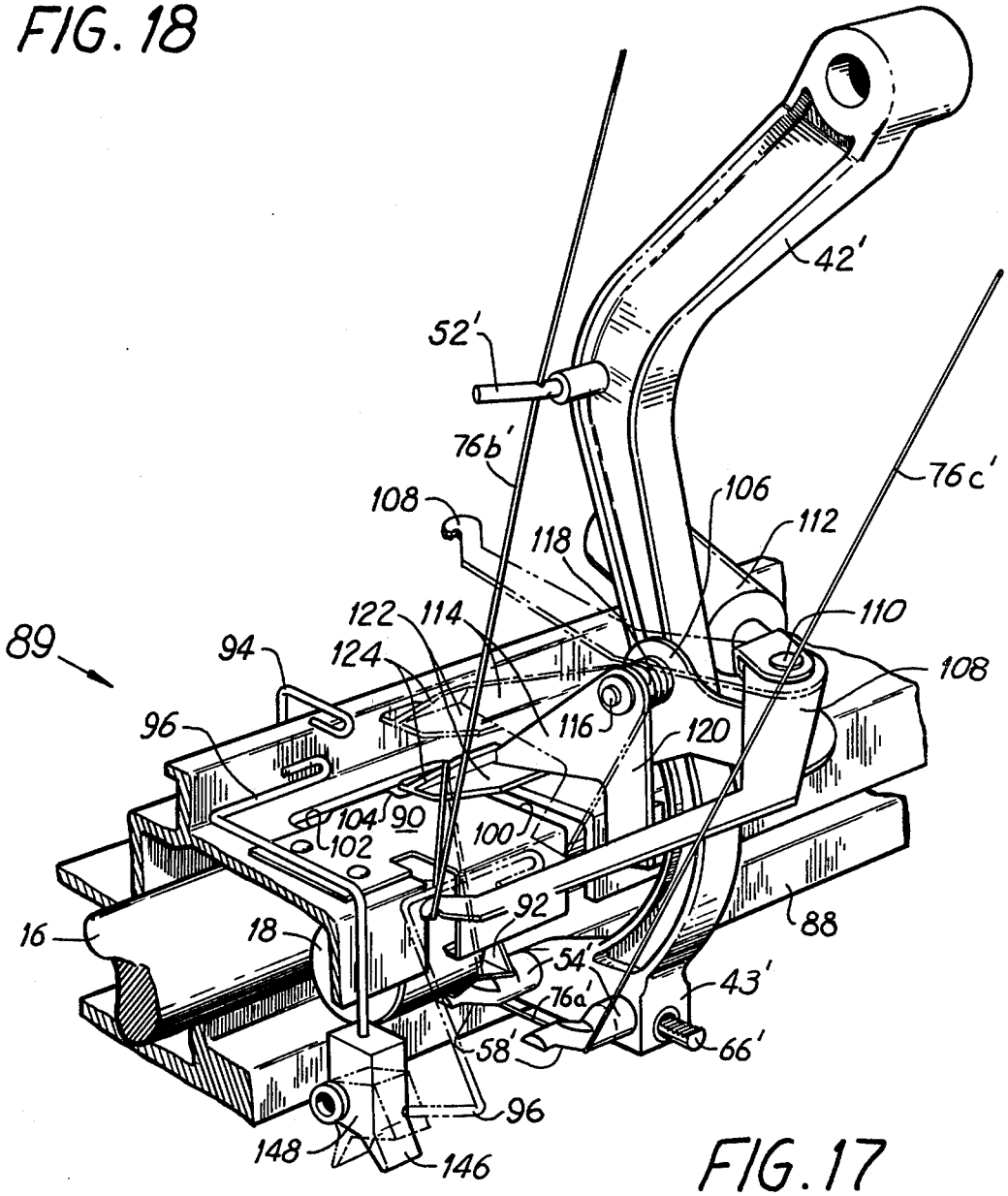
FIG. 17 is a perspective view of a delivery roll assembly and associated piecing-aid device as shown in FIGS. 14–16, and of another embodiment of components carried by the piecing apparatus support arm of FIGS. 10–13 and cooperable with components of the piecing-aid device.

Referring now to FIG. 17, wherein numerals with a prime designation indicate components identical or similar to ones previously described, the yarn engaging members 54' of arm 42' underlie and supplant the function of plate 92 of the device 89 at the spinning machine station undergoing servicing. To this end, the inclined surfaces 58' of members 54' do not slope uniformly to the free ends of such members, but rather undergo a slight reversal in the direction of their slope at locations adjacent the free ends of the members. This, in conjunction with slot shoulder 104 of plate 90 of device 89, prevents the yarn line bight 76*a'* engaged by surfaces 58' of members 54' (following rotation thereof by plunger 66') from being moved completely from the free ends of such members until member 96 of device 89 has returned to its retracted position (solid lines showing, FIGS. 15–17). Except in the foregoing respect, members 54' of arm 42' perform the same functions and are constructed, mounted and moved in the same manner as members 54 of arm 42.

Figure 18:
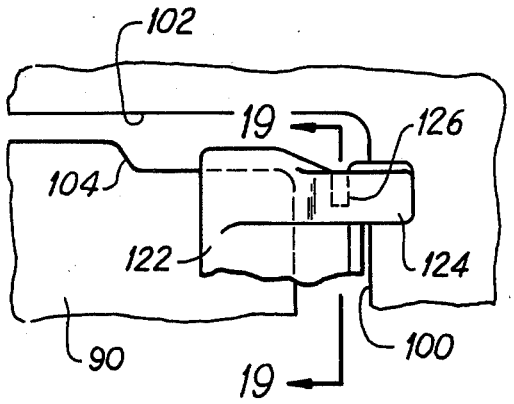
FIG. 18 is a fragmentary top view showing plate members of the yarn transfer arm and of the piecing-aid device of FIG. 17 in yarn-transferring positional relationship relative to each other.
Figure 19:
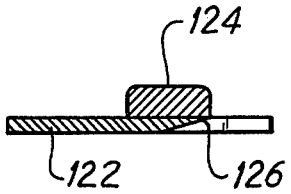
FIG. 19 is an enlarged fragmentary vertical section taken along the line 19—19 through the transfer arm plate member of FIG. 18.

A bracket 106 is affixed in any suitable manner upon that side of arm 42' from which members 54' and a notched yarn guide pin 52' extend. Bracket 106 carries first means cooperable with the aforesaid yarn guide pin 52' upon arm 42', for extending a part of the yarn-line section 76*b'* transported by arm 42' toward device 89, and for then transferring the extended yarn line to arm 96 of device 89; and second means for restraining another expanse of yarn-line section 76*b'* while the foregoing occurs, and for bringing such other part of the yarn line into association with shoulder 104 of the slot 102 within plate 90 of device 89. The first means comprises a yarn deflecting and transferring arm 108 mounted upon bracket 106 for pivotal movement about an axis 110, between retracted and extended positions respectively shown by phantom and solid lines in FIG. 17, and a piston and cylinder assembly 112 drivably connected to the inner end of arm 108 and effective when actuated to pivot the arm between its aforesaid positions. The second means comprises a plate member 114 pivotable about the generally horizontal axis of a stud 116, projecting laterally from bracket 106, between yarn retaining and yarn releasing positions respectively indicated by phantom and solid lines in FIG. 17. Plate 114 normally occupies its yarn retaining (phantom line) pivotable position, to which it is biased by a spring 118 upon stud 116, but is pivoted to its yarn-releasing position during final clockwise movement of arm 42' by then ensuing abutment and displacement of a depending section 120 of plate 114 with the front flange or apron of plate 90 of device 89. The foregoing movements of arm 42' and of plate 114 bring a laterally projecting section 122 of plate 114 into closely overlying and generally parallel relationship, best shown in FIG. 18, to that part of the horizontal upper surface of plate 90 of device 89 containing the intersection of its slots 100, 102. Referring now also to FIG. 19, the leading edge portion of plate section 122 has a smooth pad-like projection 124 thereon, and at a point upon its periphery beneath pad 124 is provided with a notch 126 that extends in an acute angular relationship relative to the plane of the upper surface of plate section 122.

When plate 114 occupies its yarn retaining position, as it does during all but the final degrees of clockwise movement of arm 42', the expanse of yarn-line section 76*b'* extended between the leading one of the members 54' of arm 42' and the notch of pin 52' of such arm passes through notch 126 of plate section 122, and is laterally constrained thereby. While laterally constrained by notch 126 of plate section 122 and by the notch within pin 52', the expanse of yarn-line section 76*b'* between the foregoing components is extended by and with the outer end of arm 108 as, in response to actuation of its associated piston and cylinder assembly 112, the arm pivots from its retracted and to its extended position. Assembly 112 maintains arm 108 in its extended position until clockwise pivotal movement of arm 42' has brought the outer end of arm 108 into an adjacent relationship, as shown in FIG. 17, to the then also extended (by mechanism 128 of FIGS. 20–22) arm 96 of device 89. Upon then-ensuing reverse actuation of assembly 112 and return of arm 108 to its retracted position, the extended part of yarn-line section 76*b'* is received by the hook-like end of arm member 96 of device 90 and is retained by it in an extended condition while arm 42' completes clockwise movement. The positional relationships between plate 114 and plate 90 of device 89 then are as shown in FIG. 18, and plate 114 has been pivoted about stud 116 to its yarn releasing pivotal position. In the yarn releasing position of plate 114, section 122 thereof is so nearly horizontal that its notch 126 no longer receives or laterally restrains yarn-line section 76*b'*. That part of the yarn line section adjacent the leading edge and pad-like projection 124 of plate section 122 therefore can and does undergo lateral movement, under the impetus of the lateral resultant forces then imposed upon it by that part of the yarn line section extended to arm 96 of device 89, along such pad and edge to and from the left (as viewed in FIG. 18) side of plate section 122, and then along the forward edge of slot 102 of plate 90 to the shoulder 104 of such slot. Shoulder 104 prevents further lateral movement of the yarn, in the same manner as it does during manual use of device 89, pending return movement of arm 96 of the device to its retracted position by mechanism 128 (FIGS. 20–22). Such return movement of arm 96 to its retracted position is produced by mechanism 128 of the piecing apparatus once other apparatus components, which may be of any desired constructions, have recommenced the supplying of sliver to spinning unit 14; and have performed a cutting of the upper part of yarn line 76*b'*, at a predetermined point, and have brought the resulting cut end of line 76*b'* into suction-retained association with the discharge tube of the spinning unit. The aforesaid yarn end is drawn further into the operational part of spinning unit as retraction of arm 96 of device 89 diminishes and finally eliminates the part of yarn line 76*b'* between it and pin 52' of arm 42'. The attainment by arm 96 of its fully retracted position effects, as in manual operation of device 89, lateral movement of the yarn extending into slot 102 of plate 90, and previously retained by and at shoulder 104, past such shoulder and to the left end portion of slot 102. Sliver-yarn piecing of an upper end portion of yarn line section 76*b'* and entrainment of its lower portion upon stub-type delivery roll 18 therefore transpire in a coordinated manner. In the latter regard, it will be appreciated that the reverse inclination of the slope of inclined surfaces 58' of members 54' is insufficient to prevent lateral movement of yarn line bight section 76*a'* from the ends of such members and onto the undersurface of delivery roll 18 when arm 96 of device 89 is retracted.

Referring now to FIGS. 20–22, the mechanism 128 for pivoting arm 96 of device 90 between its extended and retracted positions comprises a pair of linkage members 130, 132 that are pivotably connected adjacent their lower ends to a supporting bracket 134 of the piecing apparatus, and are pivotably connected at their opposite ends to another linkage member 136 having a generally hook-like end portion. Linkage 130 is also pivotably connected to the rod component of a piston and cylinder assembly 138 fixedly secured to bracket 134 and effective, upon actuation thereof, to move the aforesaid linkage members from their "parked" position of FIG. 20 to and through their position of FIG. 21 to their position of FIG. 22. Movement of the linkages from their FIG. 20 to their FIG. 21 position brings a projecting upper portion 140 of linkage 132 into engagement with a handle-like projection 146 of the member 148 supporting arm 96 of device 89. During further pivotal movement of the linkage members to their FIG. 22 position, the aforesaid engagement pivots member 148 and arm 96 to and through an overcenter position, whereupon they continue to pivot, until arm 96 reaches its fully-extended position of FIG. 22, notwithstanding cessation of engagement of portion 140 of linkage 132 with handle 146 of member 148. Upon reverse actuation of piston and cylinder assembly 138 and return movement of the linkages from their FIG. 22 position to their FIG. 20 position, the hook-like end of linkage 136 similarly engages handle 146 of member 148 and pivots member 148 and arm 96 through their overcenter position, after which they continue to pivot back to their position of FIG. 20 notwithstanding cessation of engagement between linkage 136 and handle 146 of member 148.

Although detailed embodiments of the invention have been specifically shown and described, it is to be understood that this was for purposes of illustration only, and not for purposes of limitation, the scope of the invention being in accordance with the following claims.

That which is claimed is:

1. Yarn positioning means for a mobile yarn piecing apparatus movable along the length of an elongate multi-station, open-end spinning machine to a position forwardly of a machine station requiring servicing; said station including a spinning unit, a yarn take-up package disposed at an elevation above said spinning unit, and a yarn delivery roll assembly disposed at an elevation below said spinning unit; said delivery roll assembly including a drive roll and a stub-type pressure roll defining therebetween a nip extending in the length direction of said machine; said yarn positioning means comprising:

yarn retrieving means upon said apparatus for retrieving yarn from said take-up package and for extending a line of retrieved yarn generally forwardly from said take-up package;

and yarn transfer means upon said apparatus for forming a bight in a line of the retrieved yarn at a first location distal from said delivery rolls, for transporting said yarn-line bight to a second location wherein the same is below a plane tangential to the undersurface of said stub-type and is upon that side of the vertical plane of the free end of said stub-type distal from the other end of said roll, and for thereafter permitting and guiding lateral movement of said yarn-line bight from said second location toward a third location upon the other side of said vertical plane.

2. Positioning means as in claim 1, wherein said transfer means includes a pair of elongate, spaced yarn engaging members extending in substantially parallel relationship to each other and to said stub-type delivery, said yarn-line bight being formed by and between said members at areas thereon spaced from free outer ends of said ends of said members;

mounting means upon said apparatus mounting said members for translatory movement in unision with each other toward and away from said delivery rolls, and for rotative movement about their respective longitudinal axes between first and second rotative positions;

said members having means thereon effective in said first of said rotative positions thereof to prevent movement of said yarn-line bight from said areas thereon to said free ends of said members, and effective in said second rotative position of said members to permit lateral movement of said yarn-line bight toward said free ends of said members.

3. Positioning means as in claim 2, and further including drive means carried by said mounting means for rotating said members.

4. Positioning means as in claim 3, wherein said drive means includes a plunger member carried by and movable relative to said mounting means;

gearing means innerconnecting said plunger member and said elongate members for rotating said elongate members in response to relative movement between said plunger member and said mounting means;

and abutment means upon said spinning machine for engaging said plunger member during movement of said mounting means toward said spinning machine and for thereby effecting relative movement between said plunger member and said mounting means.

5. Positioning means as in claim 3, wherein said means upon said elongate members for preventing and permitting said yarn-line bight movement respectively comprise a generally V-shaped notch within one side surface of each of said members, and an inclined surface upon the opposite side of each of said members and sloping toward its said free end.

6. Positioning means as in claim 1, wherein said yarn-line bight comprises the lowermost section of a generally U-shaped yarn line further having a rearward section extending from said bight section to an elevation adjacent said spinning unit, and a forward section extending from said bight section to said take-up package;

and further including second yarn transfer means for initially associating a line of the retrieved yarn with said first-mentioned transfer means and for in cooperation therewith forming said generally U-shaped line.

7. In combination with an open-spinning machine having a spinning station whereat yarn produced by a spinning unit passes into operative association with a pair of yarn delivery rolls and then to a yarn take-up package;

said station being restorable to production following yarn breakage by the performance thereat of a piecing operation including the steps of operatively associating a first section of a line of yarn withdrawn from said package with said delivery rolls, and operatively associating a second section of said yarn line with said spinning unit;

a piecing-aid device affixed to said spinning machine at said station for coordinating said steps of a piecing operation performed thereat;

said device including an arm member movable between retracted and extended positions, and adapted when in its extended position to receive thereon a loop of said second yarn line section;

movement of said arm member of said device to its said retracted position being effective to eliminate said loop and to thereby establish operative association of said second yarn line section with said spinning unit;

said device further including yarn retaining means, cooperable with said arm member and adapted during a piecing operation to engage a part of said second yarn line section, for preventing establishment of an operative association between said first yarn line section and said delivery rolls while said arm member occupies its said extended position, and for permitting the establishment of an operative association between said first yarn line section and said delivery rolls in response to movement of said arm member to its said retracted position;

and a mobile automatic yarn piecing apparatus adapted to move along said machine to said station and perform a piecing operation thereat; the improvement comprising:

yarn retrieving means upon said apparatus for withdrawing yarn from said take-up package;

yarn positioning means upon said apparatus for redirecting the withdrawn yarn into a line having a first section adapted and positioned to be operatively associated with said delivery rolls, and a second section adapted and positioned to be operatively associated with said spinning unit;

linkage means upon said piecing apparatus for moving said arm member of said piecing-aid device from its said retracted and to its said extended position, and for thereafter moving said arm member back to its said retracted position;

yarn looping means upon said piecing apparatus for forming a loop within said second section of said yarn line and for transferring said loop to said arm member of said piecing-aid device while said arm member occupies its said extended position;

and guide means upon said apparatus for guiding a part of said second yarn line section into engagement with said yarn retaining means upon said piecing-aid device.

8. The combination of claim 7, wherein said piecing-aid device includes a slotted plate fixedly mounted upon said spinning machine adjacent said delivery rolls, and said retaining means comprises a shoulder-like projection upon an edge portion of a slot of said plate;

said piecing apparatus including a support arm movable toward said delivery rolls of said machine station and toward said slotted plate of said piecing-aid device;

and means mounting said guide means upon said support arm for movement therewith toward and into engagement with said slotted plate, and for then ensuing movement of said guide means relative to said support arm and said plate.

9. The combination of claim 8, wherein said looping means of said piecing apparatus includes a looping arm mounted upon said support arm for pivoted movement relative to it between extended and retracted positions; and drive means upon said support arm for imparting pivoted movement to said looping arm.

* * * * *

UNITED STATES PATENT AND TRADEMARK OFFICE

CERTIFICATE OF CORRECTION

PATENT NO. : 4,248,037

DATED : February 3, 1981

INVENTOR(S) : Charles R. Martin, Philip B. Tarbox, Stephen W.Yates

It is certified that error appears in the above-identified patent and that said Letters Patent are hereby corrected as shown below:

Column 2, line 41, "tive to to" should read--tive to--; line 43, "servicing to," should read--servicing,--; line 44, "yarn-like" should read--yarn-line--. Column 4, line 62, "silver" should read--sliver--. Column 8, line 13, "42 its" should read--42 to its--; line 18, "completed" should read--completely--. Column 9, lines 11 and 12, "silver" should read--sliver--. Column 13, line 34, "type and" should read--type roll and--; line 36, "type distal" should read--type roll distal--; line 44, "delivery," should read--delivery rolls,--; line 49, "unision" should read--unison--.

Signed and Sealed this

*Twenty-sixth* Day of *May 1981*

[SEAL]

*Attest:*

RENE D. TEGTMEYER

*Attesting Officer*

*Acting Commissioner of Patents and Trademarks*